US005507465A

United States Patent [19]

Borle

[11] Patent Number: 5,507,465

[45] Date of Patent: Apr. 16, 1996

[54] BLOW-OUT PREVENTER

[76] Inventor: Del Borle, R.R. #2, Leduc, Alberta, Canada, T9E 2X2

[21] Appl. No.: 418,627

[22] Filed: Apr. 7, 1995

[51] Int. Cl.[6] ..... E21B 33/06

[52] U.S. Cl. ..... 251/1.2; 251/1.1

[58] Field of Search ..... 251/1.1, 1.2

[56] References Cited

U.S. PATENT DOCUMENTS

| | | | |
|---|---|---|---|
| 2,846,178 | 8/1958 | Minor | 251/1.2 |
| 3,591,125 | 7/1971 | Lewis | 251/1.2 |
| 3,860,067 | 1/1975 | Rodgers | 166/121 |
| 4,460,149 | 7/1984 | Schaeper et al. | 251/1.2 |
| 4,508,311 | 4/1985 | Just et al. | 251/1.2 |
| 4,949,785 | 8/1990 | Beard et al. | 166/84 |

*Primary Examiner*—John C. Fox
*Attorney, Agent, or Firm*—Anthony R. Lambert

[57] ABSTRACT

A blow out preventer is described including a housing with a first annular wedge member fixed to an interior sidewall of the housing. A second annular wedge assembly is provided which includes a plurality of wedge segments disposed within an interior of the housing. The contact face of each of the wedge segments in the second annular wedge assembly is in sliding face to face contact with the contact face of the first annular wedge member. The second annular wedge assembly is movable between an open position spaced from central drill pipe receiving bore and a closed position in sealing engagement with a drill pipe disposed within the central drill pipe receiving bore. An annular piston seal is disposed within the interior at the second end of the housing. The piston has a first contact face and a second contact face. The first contact face engages the second annular wedge assembly. When the second contact face is exposed to fluid pressure symptomatic of a blow out condition, the piston moves in response to such pressure to move the inclined planes formed by the contact faces of the wedge segments of the second annular wedge assembly up the inclined plane formed by the contact surface of the first annular wedge member to the closed position.

6 Claims, 3 Drawing Sheets

BLOW-OUT PREVENTER

FIELD OF THE INVENTION

The present invention relates to a blow out preventer used to prevent an uncontrolled release of fluids when drilling for oil and gas.

BACKGROUND OF THE INVENTION

Most blow out preventers used when drilling for oil and gas are manually activated. A member of the drilling crew presses a switch on the master control panel when readings indicate, by a pressure increase within the annulus, that "blow out" conditions may exist. A blow out is an uncontrolled release of fluids up the annulus of the oil or gas well. Under normal drilling conditions the pressure of oil and gas endeavouring to escape up the annulus is controlled by the weight of a column of drilling fluid. When the pressure of oil and gas endeavouring to escape up the annulus exceed a counter-pressure exerted by the weight of the column of fluid, a "blow out" occurs. Once activated, the blow out preventer closes the annulus with two large hydraulic rams.

Problems arise when the drilling crew is not attentive and miss warning signs that precede a blow out or when the drilling crew has no or no sufficient warning of an impending blow out.

SUMMARY OF THE INVENTION

What is required is a blow out preventer that will automatically close in response to a pressure increase within the annulus that precedes a blow out.

According to the present invention there is provided a blow out preventer including a housing having a first end, a second end, an interior, an interior sidewall and a central drill pipe receiving bore. A first annular wedge member is fixed to the interior sidewall of the housing with a thick end of the wedge oriented toward the first end, a thin end of the wedge toward the second end, and a contact face forming an inclined plane that extends between the thin end and the thick end. A second annular wedge assembly is provided which includes a plurality of wedge segments disposed within the interior of the housing. A thick end of each of the wedge segments is oriented toward the second end, a thin end of each of the wedge segments oriented toward the first end, and a contact face of each of the wedge segments forms an inclined plane that extends between the thin end and the thick end. The contact face of each of the wedge segments in the second annular wedge assembly is in sliding face to face contact with the contact face of the first annular wedge member. The second annular wedge assembly is movable between an open position spaced from central drill pipe receiving bore and a closed position in sealing engagement with a drill pipe disposed within the central drill pipe receiving bore. An annular piston seal is disposed within the interior at the second end of the housing. The piston has a first contact face and a second contact face. The first contact face engages the second annular wedge assembly. When the second contact face is exposed to fluid pressure symptomatic of a blow out condition, the piston moves in response to such pressure to move the inclined planes formed by the contact faces of the wedge segments of the second annular wedge assembly up the inclined plane formed by the contact surface of the first annular wedge member to the closed position.

Although beneficial results may be obtained through the use of the blow out preventer, as described above, it is preferable if some means is provided for repositioning the second annular wedge assembly to an open position. Even more beneficial results may, therefore, be obtained when an axially movable wedge positioning member is provided at the first end of the housing. The wedge positioning member has a depending contact member that engages the second annular wedge assembly. The wedge positioning member has a contact face oriented toward the first end of the housing. Pressure exerted upon the contact face to move the wedge positioning member results in the depending contact member pushing the second annular wedge assembly to the open position.

Although beneficial results may be obtained through the use of the blow out preventer, as described above, it is highly desirable to be able to preset the pressure sensitivity of the blow out preventer so that second annular wedge assembly does not move to the closed position until a preset pressure threshold is reached. Even more beneficial results may, therefore, be obtained when a fluid chamber is provided at the first end of the housing. Means is provided to preset a desired hydraulic pressure within the fluid housing thereby creating a force upon the contact face of the wedge positioning member to hold the second annular wedge assembly away from the first annular wedge member until such preset hydraulic pressure is exceeded by pressure upon the piston seal.

Once the basic teachings of the invention are understood, further features may be added to enhance performance. For example, mating guides can be provided on the first annular wedge member and the wedge segments of the second annular wedge assembly to ensure consistent relative movement. As well, the wedge segments of the second annular seal assembly can be provided with overlapping seals which circumscribe the central drill pipe receiving bore to improve the sealing ability of the second annular seal assembly.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
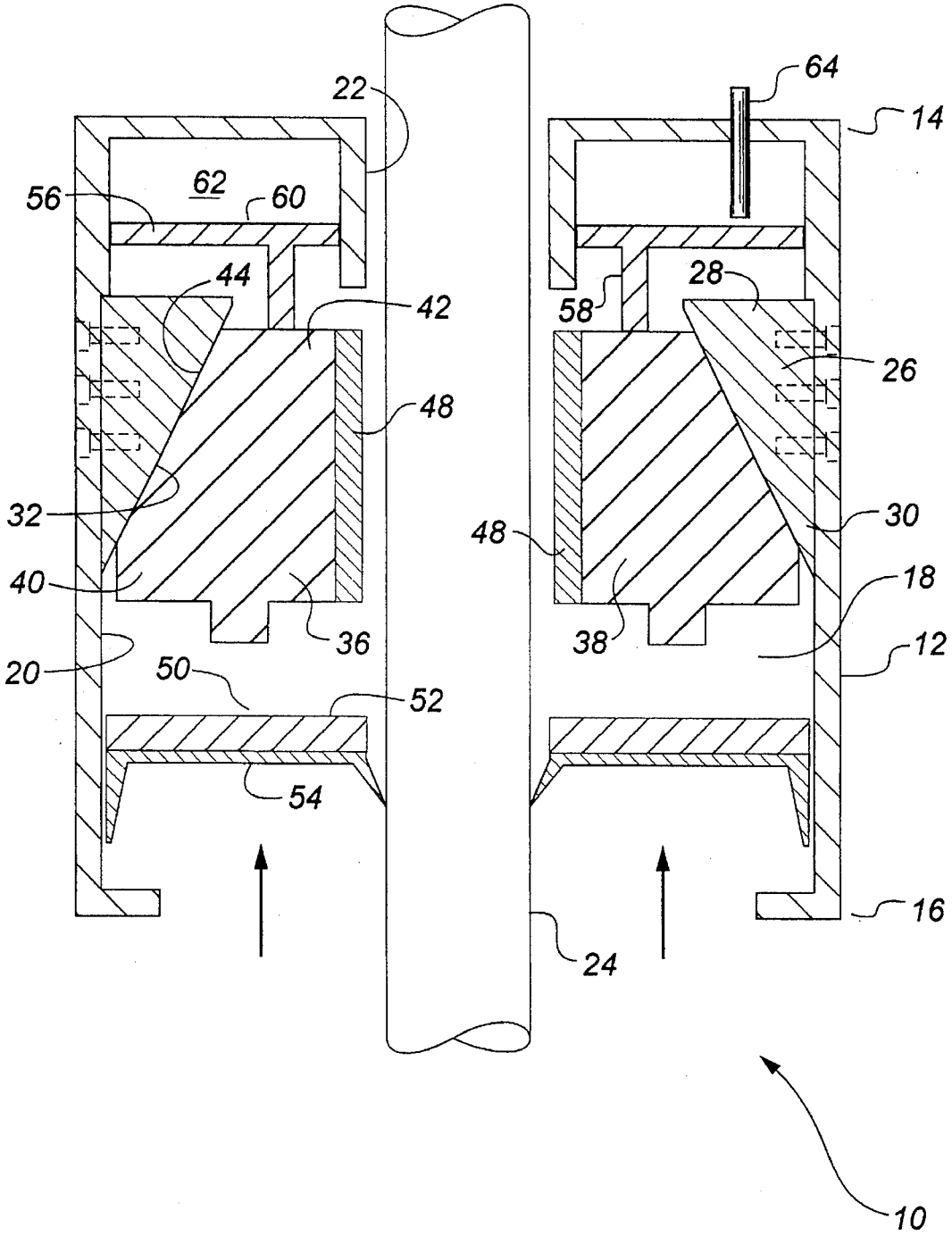
FIG. 1 is a side elevation view in section of a blow out preventer constructed in accordance with the teachings of the present invention, in an open position.

The preferred embodiment, a blow out preventer generally identified by reference numeral 10, will now be described with reference to FIGS. 1 through 4.

Figure 2:
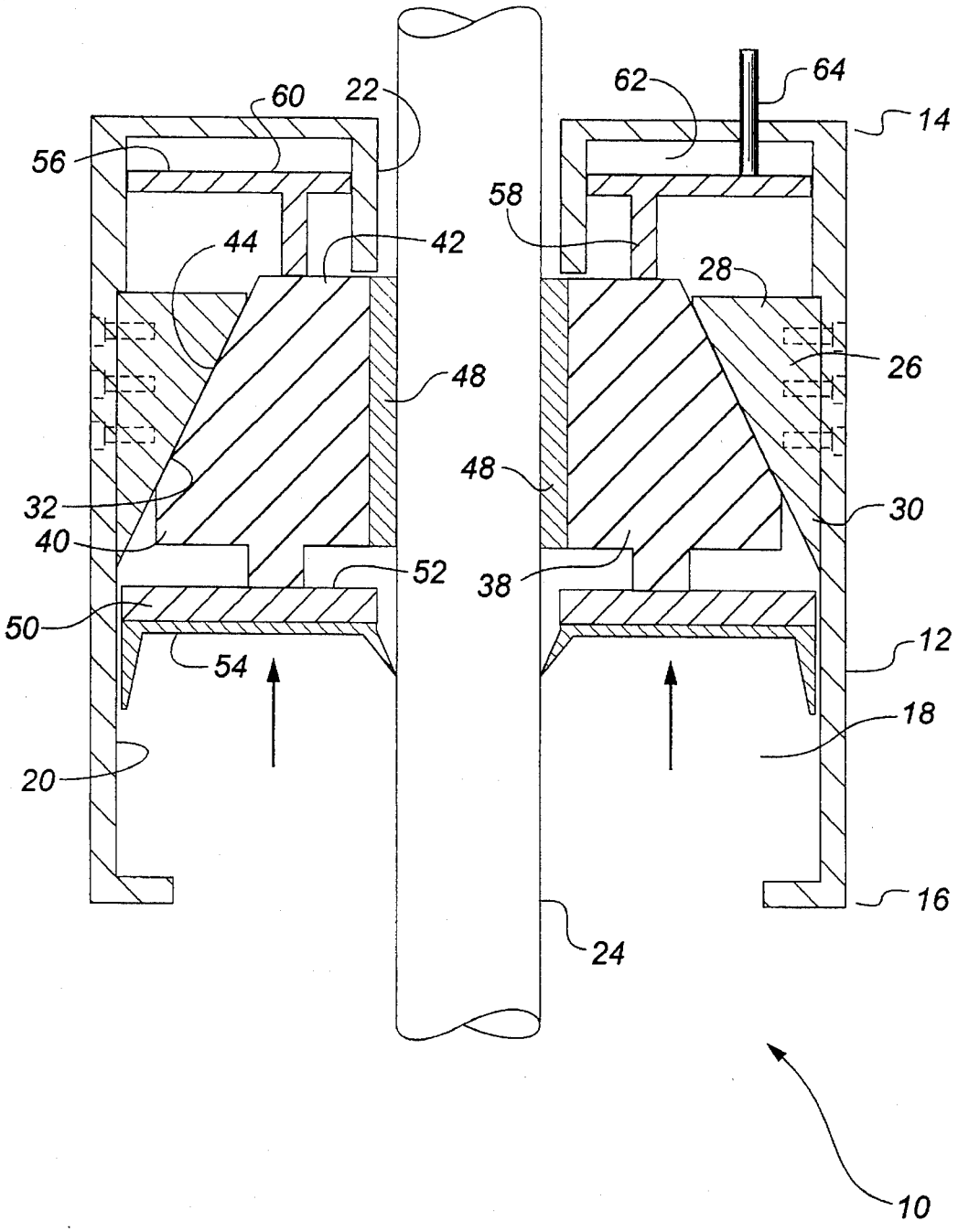
FIG. 2 is a side elevation view in section of the blow out preventer illustrated in FIG. 1 in a closed position.
Figure 3:
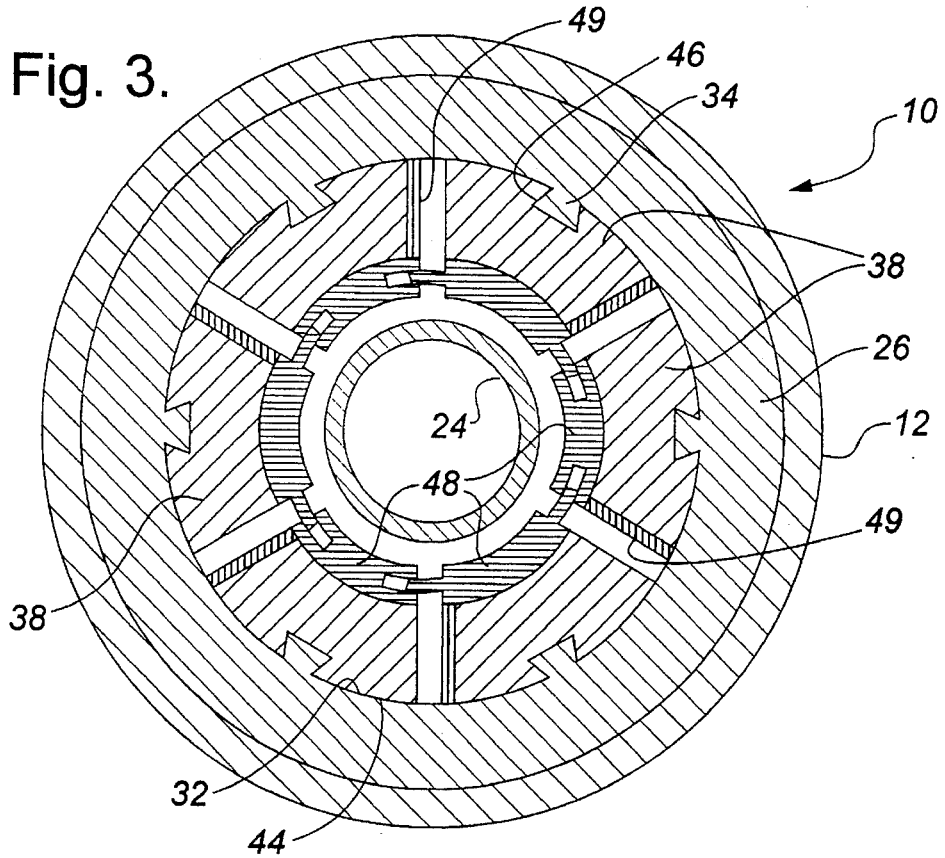
FIG. 3 is a top plan view of the blow out preventer in an open position as illustrated in FIG. 1.
Figure 4:
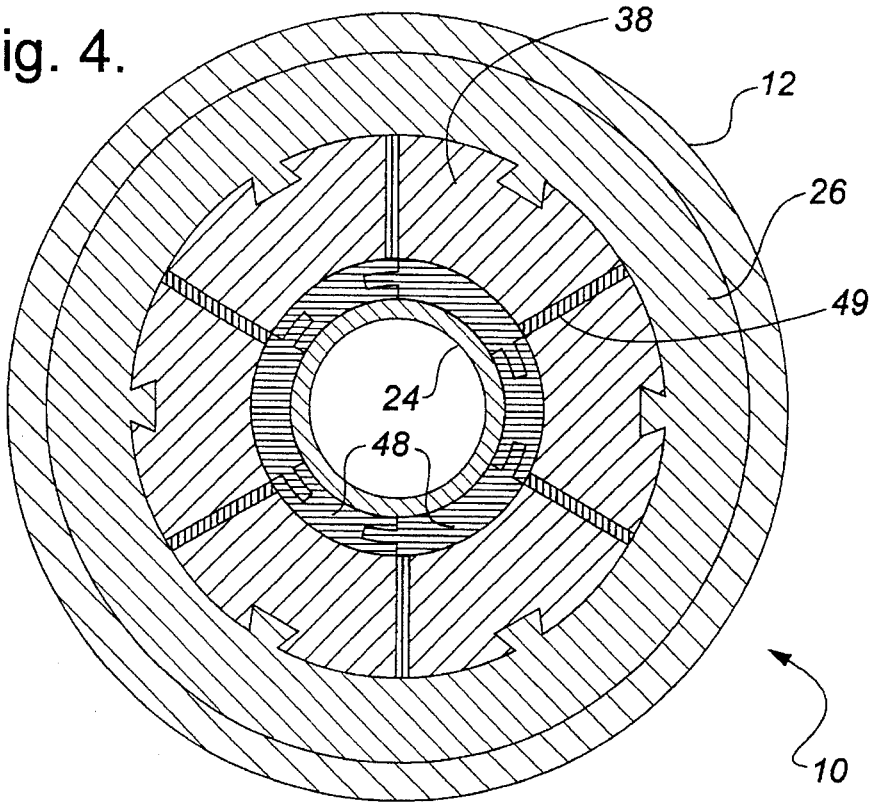
FIG. 4 is a top plan view of the blow out preventer in a closed position as illustrated in FIG. 2.

Referring to FIGS. 1 and 2, blow out preventer 10 includes a housing 12 having a first or top end 14, a second or bottom end 16, an interior 18, an interior sidewall 20 and a central drill pipe receiving bore 22. It is intended that a drill pipe 24 be positioned within central drill pipe receiving bore 22. A first annular wedge member 26 is fixed to interior sidewall 20 of housing 12. A thick end 28 of first annular wedge member 26 is oriented toward first end 14. A thin end 30 is oriented toward second end 16. A contact face 32 forms an inclined plane that extends between thin end 30 and thick end 28. Referring to FIG. 3, first annular wedge member 26 has a plurality of dovetail guide tongues 34. Referring to FIGS. 1 and 2, a second annular wedge assembly is provided generally indicated by reference numeral 36. Second annular wedge assembly 36 includes a plurality of wedge segments 38 disposed within interior 18 of housing 12. Each of wedge segments 38 has a thick end 40 oriented toward second end 16, a thin end 42 oriented toward first end 14, and a contact face 44 forming an inclined plane that extends between thin end 42 and thick end 40. Contact face 44 of each of wedge segments 38 in second annular wedge assembly 36 is in sliding face to face contact with contact face 32 of first annular wedge member 26. Referring to FIG. 3, each of wedge segments 38 has a dovetail guide slot 46 which receives one of guide tongues 34 of first annular wedge member 26. Second annular wedge assembly 36 is movable between an open position and a closed position. In the open position, second annular wedge assembly 36 is spaced from drill pipe 24 which is disposed in central drill pipe receiving bore 22, as illustrated in FIG. 1. In the closed position, second annular wedge assembly 36 is in sealing engagement with drill pipe 24 disposed within central drill pipe receiving bore 22, as illustrated in FIG. 2. Referring to FIGS. 3 and 4, wedge segments 38 of second annular seal assembly 36 have overlapping seals 48 and peripheral edge seals 49. It can be seen in FIGS. 3 and 4, the manner in which seals 48 circumscribe central drill pipe receiving bore 22. It can similarly be seen from FIG. 4, that peripheral edge seals 49 tightly engage when wedge segments 38 are in the closed position. Referring to FIGS. 1 and 2, an annular piston seal 50 is disposed within interior 18 at second end 16 of housing 12. Piston seal 50 has a first contact face 52, and a second contact face 54. First contact face 52 engages second annular wedge assembly 36. Second contact face 54 is exposed to fluid pressure in the annulus. When pressures symptomatic of a blow out condition are encountered, piston seal 50 moves in response to such pressure to move the inclined planes formed by contact faces 44 of wedge segments 38 of second annular wedge assembly 36 up the inclined plane formed by contact face 32 of first annular wedge member 26 to the closed position. Referring to FIGS. 1 and 2, an axially movable wedge positioning member 56 is provided at first end 14 of housing 12. Wedge positioning member 56 has a depending contact member 58 that engages second annular wedge assembly 36. Wedge positioning member 56 has a contact face 60 oriented toward first end 14 of housing 12. Pressure exerted upon contact face 60 to move wedge positioning member 56 results in depending contact member 58 pushing second annular wedge assembly 36 to the open position. A fluid chamber 62 is provided at first end 14 of housing 12. A valve 64 is provided whereby hydraulic fluid is introduced into fluid chamber 62 to preset a desired hydraulic pressure within fluid chamber 62 thereby creating a force upon contact face 60 of wedge positioning member 56 to hold second annular wedge assembly 36 away from first annular wedge member 26 until such preset hydraulic pressure is exceeded by pressure upon piston seal 50.

The use and operation of blow out preventer 10 will now be described with reference to FIGS. 1 through 4. Referring to FIG. 1, blow out preventer 10 is placed in position, and hydraulic fluid is introduced into fluid chamber 62 via valve 64 to preset a desired hydraulic pressure within fluid chamber 62. The pressure within fluid chamber 62 exerts a force upon contact face 60 of wedge positioning member 56. Pressure exerted upon contact face 60 to move wedge positioning member 56 results in depending contact member 58 pushing second annular wedge assembly 36 to the open position, illustrated in FIG. 1. Depending contact member 58 will continue to hold second annular wedge assembly 36 away from first annular wedge member 26 until a pressure is exerted upon piston seal 50 that exceeds the pressure within fluid chamber 62. When this occurs piston seal 50 moves in response to such pressure to move second annular wedge assembly 36 to the closed position illustrated in FIG. 2. Upon movement of piston seal 50 second annular wedge assembly 36 is forced upwardly with the inclined planes formed by contact faces 44 of wedge segments 38 of second annular wedge assembly 36 sliding up the inclined plane formed by contact face 32 of first annular wedge member 26. The movement of wedge segments 38 of second annular wedge assembly 36 relative to first annular wedge member 26 is guided by the engagement between guide tongues 34 and guide slots 46, as illustrated in FIGS. 3 and 4. Such engagement ensures that wedge segments 38 are moved into sealing engagement in the closed position illustrated in FIG. 4. In addition to seal piston 50, the sealing function is performed by engagement between peripheral edge seals 49 on each wedge segments 38 and by overlapping seals 48, as illustrated in FIG. 4. It will be appreciated that the greater the pressure exerted upon piston seal 50 the greater the force exerted to press peripheral edge seals 49 into sealing engagement with each other and overlapping seals 48 into sealing engagement with drill pipe 24 disposed within central drill pipe receiving bore 22. In order to reset blow out preventer 10, a counter-balancing pressure is exerted by pump hydraulic fluids via valve 64 into fluid chamber 62, when the well is considered to be back under control and it is deemed to be safe to do so. The pressure within fluid chamber 62 exerts a force upon contact face 60 moves wedge positioning member 56 resulting in depending contact member 58 again pushing second annular wedge assembly 36 to the open position, illustrated in FIG. 1.

It will be apparent to one skilled in the art that modifications may be made to the illustrated embodiment without departing from the spirit and scope of the invention as hereinafter defined in the claims.

The Embodiments of the Invention in which and Exclusive Property of Privilege is claimed are Defined as Follows:

1. A blow out preventer, comprising:

a housing having a first end, a second end, an interior, an interior sidewall and a central drill pipe receiving bore;

a first annular wedge member fixed to the interior sidewall of the housing with a thick end of the wedge oriented toward the first end, a thin end of the wedge toward the second end, and a contact face forming an inclined plane that extends between the thin end and the thick end;

a second annular wedge assembly including a plurality of wedge segments disposed within the interior of the housing, with a thick end of each of the wedge segments oriented toward the second end, a thin end of each of the wedge segments oriented toward the first end, and a contact face of each of the wedge segments forming an inclined plane that extends between the thin end and the thick end, the contact face of each of the wedge segments in the second annular wedge assembly being in sliding face to face contact with the contact face of the first annular wedge member, the second annular wedge assembly being movable between an open position spaced from central drill pipe receiving bore and a closed position in sealing engagement with a drill pipe disposed within the central drill pipe receiving bore; and an annular piston seal disposed within the interior at the second end of the housing, the piston having a first contact face and a second contact face, the first contact face engaging the second annular wedge assembly, such that when the second contact face is exposed to fluid pressure symptomatic of a blow out condition, the piston seal moves in response to such pressure increases to move the inclined planes formed by the contact faces of the wedge segments of the second annular wedge assembly up the inclined plane formed by the contact surface of the first annular wedge member to the closed position.

2. The blow out preventer as defined in claim 1, wherein an axially movable wedge positioning member is provided at the first end of the housing, the wedge positioning member having a depending contact member that engages the second annular wedge assembly, the wedge positioning member having a contact face oriented toward the first end of the housing, such that pressure exerted upon the contact face to move the wedge positioning member results in the depending contact member pushing the second annular wedge assembly to the open position.

3. The blow out preventer as defined in claim 2, wherein a fluid chamber is provided at the first end of the housing means being provided to preset a desired hydraulic pressure within the fluid chamber thereby creating a force upon the contact face of the wedge positioning member, to hold the second annular wedge assembly away from the first annular wedge member until such preset hydraulic pressure is exceeded by pressure upon the piston seal.

4. The blow out preventer as defined in claim 1, wherein the first annular wedge member and the wedge segments of the second annular wedge assembly have mating guides.

5. The blow out preventer as defined in claim 1, wherein the wedge segments of the second annular seal assembly have overlapping seals which circumscribe the central drill pipe receiving bore.

6. A blow out preventer, comprising:

a housing having a first end, a second end, an interior, an interior sidewall and a central drill pipe receiving bore;

a first annular wedge member fixed to the interior sidewall of the housing with a thick end of the wedge oriented toward the first end, a thin end of the wedge toward the second end, and a contact face forming an inclined plane that extends between the thin end and the thick end, the first annular wedge member having a plurality of guide channels;

a second annular wedge assembly including a plurality of wedge segments disposed within the interior of the housing, with a thick end of each of the wedge segments oriented toward the second end, a thin end of each of the wedge segments oriented toward the first end, and a contact face of each of the wedge segments forming an inclined plane that extends between the thin end and the thick end, the contact face of each of the wedge segments in the second annular wedge assembly being in sliding face to face contact with the contact face of the first annular wedge member, each of the wedge segments having a guide tongue which is received in one of the guide channels of the first annular wedge member, the second annular wedge assembly being movable between an open position spaced from the central drill pipe receiving bore and a closed position in sealing engagement a drill pipe disposed within the central drill pipe receiving bore, the wedge segments of the second annular seal assembly having overlapping seals which circumscribe the central drill pipe receiving bore;

an annular piston seal disposed within the interior at the second end of the housing, the piston seal having a first contact face and a second contact face, the first contact face engaging the second annular wedge assembly, such that when the second contact face is exposed to fluid pressure symptomatic of a blow out condition, the piston seal moves in response to such pressure increases to move the inclined planes formed by the contact faces of the wedge segments of the second annular wedge assembly up the inclined plane formed by the contact surface of the first annular wedge member to the closed position;

an axially movable wedge positioning member is provided at the first end of the housing, the wedge positioning member having a depending contact member that engages the second annular wedge assembly, the wedge positioning member having a contact face oriented toward the first end of the housing, such that pressure exerted upon the contact face to move the wedge positioning member results in the depending contact member pushing the second annular wedge assembly to the open position; and a fluid chamber is provided at the first end of the housing, a valve is provided whereby hydraulic fluid is introduced into the fluid chamber to preset a desired hydraulic pressure within the fluid chamber thereby creating a force upon the contact face of the wedge positioning member to hold the second annular wedge assembly away from the first annular wedge member until such preset hydraulic pressure is exceeded by pressure upon the piston seal.

* * * * *